US009080354B2

(12) United States Patent
Krishnan

(10) Patent No.: US 9,080,354 B2
(45) Date of Patent: Jul. 14, 2015

(54) LOGIC-BASED SLIDING DOOR INTERLOCK

(75) Inventor: Venkatesh Krishnan, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 884 days.

(21) Appl. No.: 13/160,650

(22) Filed: Jun. 15, 2011

(65) Prior Publication Data

US 2012/0323471 A1 Dec. 20, 2012

(51) Int. Cl.

| | |
|---|---|
| ***E05B 83/40*** | (2014.01) |
| ***E05B 83/34*** | (2014.01) |
| ***E05B 81/70*** | (2014.01) |
| *E05B 77/26* | (2014.01) |
| *E05B 81/16* | (2014.01) |

(52) U.S. Cl.

CPC ..... *E05B 83/34* (2013.01); *E05B 81/70* (2013.01); *E05B 83/40* (2013.01); *E05B 77/26* (2013.01); *E05B 81/16* (2013.01)

(58) Field of Classification Search

CPC ..... E05B 83/34; E05B 83/40; E05B 81/16; E05B 81/70; E05B 77/26

USPC ..... 701/112; 318/466; 340/438

See application file for complete search history.

(56) References Cited

U.S. PATENT DOCUMENTS

| | | | | |
|---|---|---|---|---|
| 5,454,618 | A * | 10/1995 | Sullivan | 296/97.22 |
| 5,538,312 | A * | 7/1996 | Lehmkuhl | 296/97.22 |
| 5,769,481 | A * | 6/1998 | Cooper | 296/97.22 |
| 5,906,405 | A * | 5/1999 | Cooper | 296/97.22 |
| 6,199,923 | B1 | 3/2001 | Rice et al. | |
| 6,256,932 | B1 * | 7/2001 | Jyawook et al. | 49/503 |
| 6,435,600 | B1 * | 8/2002 | Long et al. | 296/155 |
| 6,588,829 | B2 * | 7/2003 | Long et al. | 296/155 |
| 6,739,633 | B2 | 5/2004 | Holloway et al. | |
| 6,808,226 | B2 * | 10/2004 | Hirano | 296/155 |
| 7,525,272 | B2 * | 4/2009 | Oh | 318/466 |
| 7,537,269 | B2 * | 5/2009 | Tseng et al. | 296/155 |
| 7,766,410 | B2 * | 8/2010 | Tseng et al. | 296/97.22 |
| 2001/0010429 | A1 * | 8/2001 | Jyawook et al. | 292/347 |
| 2002/0153744 | A1 * | 10/2002 | Long et al. | 296/155 |
| 2003/0062210 | A1 * | 4/2003 | Farmer | 180/286 |
| 2004/0049987 | A1 * | 3/2004 | Hirano | 49/360 |
| 2006/0220412 | A1 * | 10/2006 | Norton | 296/97.2 |
| 2007/0257505 | A1 * | 11/2007 | Tseng et al. | 296/97.22 |
| 2008/0122246 | A1 * | 5/2008 | Oh | 296/97.22 |
| 2008/0258552 | A1 * | 10/2008 | Tseng et al. | 307/10.1 |
| 2009/0091438 | A1 * | 4/2009 | Rovik | 340/457 |

FOREIGN PATENT DOCUMENTS

KR 100756944 B1 9/2007

* cited by examiner

*Primary Examiner* — Stephen K Cronin
*Assistant Examiner* — Sherman Manley
(74) *Attorney, Agent, or Firm* — Jason Rogers; MacMillan, Sobanski & Todd, LLC

(57) ABSTRACT

A fuel door and a sliding door are on the same side of a vehicle. The sliding door has power locking and power child locking. To prevent the sliding door from interfering with the fuel door during refueling, a lock controller responds to the fuel door moving to the open position by 1) preserving a current outside locked or unlocked state and a current inside locked or unlocked state of the sliding door, 2) initiating or maintaining the outside locked state and inside locked state, and 3) after the fuel door moving to the closed position, restoring or maintaining the preserved current outside locked or unlocked state and the preserved current inside locked or unlocked state.

6 Claims, 4 Drawing Sheets

LOGIC-BASED SLIDING DOOR INTERLOCK

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to passenger sliding door operation for transportation vehicles, and, more specifically, to preventing collision between a sliding door and a fuel door adjacent to the sliding door opening.

A sliding passenger door is a popular item on vans and minivans. Typically, both the left and right sides of a minivan may be equipped with sliding passenger doors for the second and third rows of seating. Conventionally, a fuel door covering a gas cap and gas filler neck is also located on one side of the vehicle, rearward of one of the sliding doors. Because of the desire to have a large ingress/egress opening when the sliding passenger door is open, the range of travel of the sliding door typically overlaps the area where a fuel door is installed.

In order to prevent the sliding door from colliding with an open fuel door at a refueling stop, various protection systems have been put into practice. For example, a mechanical interlock using levers activated by the opening of the fuel door has been used to block operation of the sliding door until the fuel door is reclosed. It would be desirable to avoid the added costs of such a mechanical interlock system together with the manufacturing and resulting warranty costs associated with the mechanical system.

It has also been suggested to include a position sensor in a fuel door that would disable operation of a power system for a powered sliding door when the fuel door is ajar. However, it would be desirable to avoid the necessity to make changes to the power sliding door system itself. Furthermore, prevention of powered sliding door operation without a mechanical interlock does not prevent accidental manual (i.e., unpowered) opening of the sliding door when the fuel door is open, especially from inside the passenger cabin where the open state of the fuel door is less apparent to the person opening the door.

SUMMARY OF THE INVENTION

In one aspect of the invention, a transportation vehicle comprises a fuel door on a first side of the vehicle having an open position and a closed position. A sensor provides a fuel door ajar signal indicating whether the fuel door is in the open position or the closed position. A sliding door on the first side of the vehicle for passenger ingress and egress is movable between an open position and a closed position, wherein the open position of the sliding door interferes with the open position of the fuel door. The sliding door has an interior door handle and an exterior door handle, and there is at least one power lock switch for manually generating a lock signal or an unlock signal. A child lock switch manually generates a power child locking signal or a power child unlocking signal. An electronically-controlled latch system in the sliding door is responsive to 1) a power lock command for putting the latch system in an outside locked state for preventing the sliding door from being moved from the closed position using the exterior door handle, 2) a power unlock command for putting the latch system in an outside unlocked state for enabling the sliding door to be moved from the closed position using the exterior door handle, 3) a child lock command for putting the latch system in an inside locked state for preventing the sliding door from being moved from the closed position using the interior door handle, and 4) a child unlock command for putting the latch system in an inside unlocked state for enabling the sliding door to be moved from the closed position using the interior door handle. A lock controller is coupled to the sensor, the power lock switch, the child lock switch, and the latch system for responding to the fuel door moving to the open position by 1) preserving a current outside locked or unlocked state and a current inside locked or unlocked state, 2) initiating or maintaining the outside locked state and inside locked state, and 3) after the fuel door moving to the closed position, restoring or maintaining the preserved current outside locked or unlocked state and the preserved current inside locked or unlocked state.

Many conventional power locking systems have been configured to latch and unlatch all passenger doors in concert. In the present invention, it is preferred (but not required) to configure the locking system to provide individual control of the locking of at least the sliding door (as is often done for the driver's door).

DETAILED DESCRIPTION OF PREFERRED EMBODIMENTS

Figure 1:
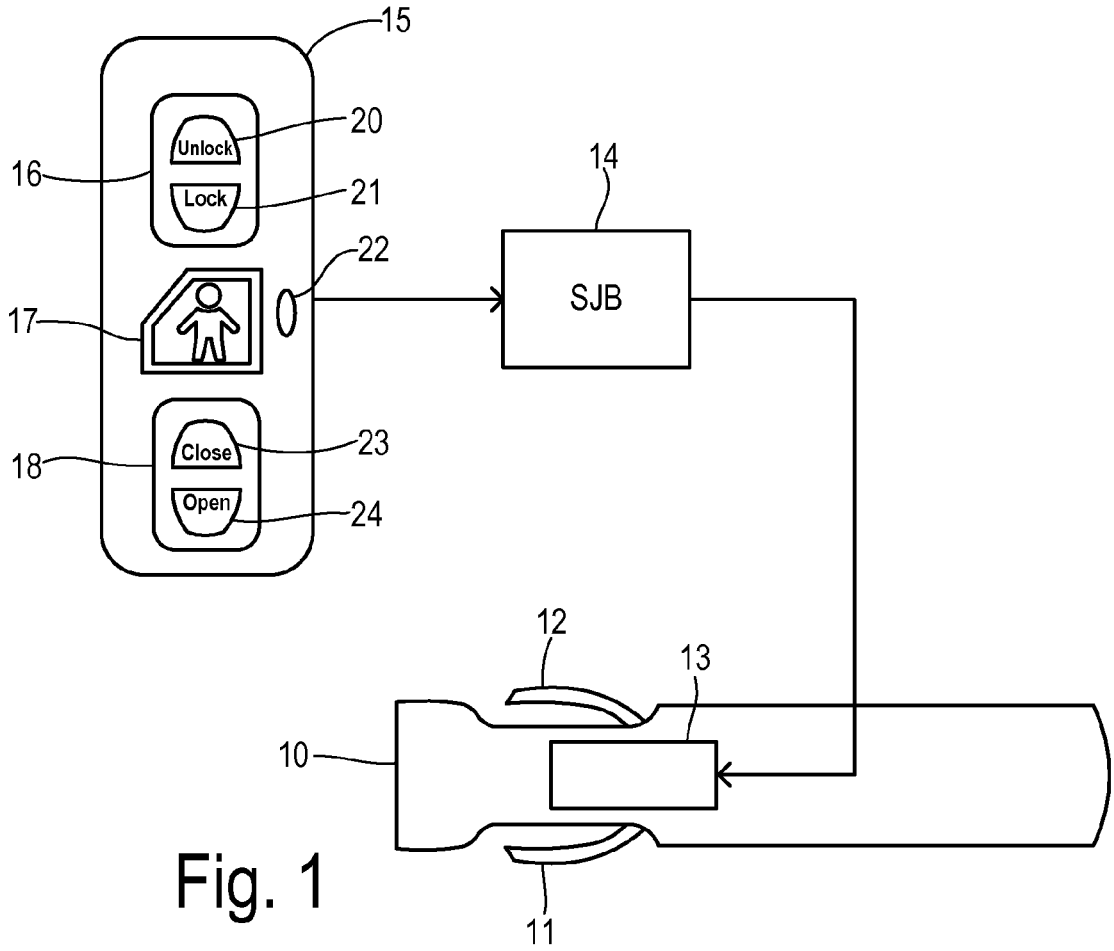
FIG. 1 is a block diagram showing a sliding door lock system with power locks and power child locks.

Referring now to FIG. 1, a typical power lock system will be described. A sliding door 10 has an outside handle 11 and an inside handle 12 for manually opening sliding door 10 when it is not locked by a latch system 13. Latch system 13 is electronically controlled by a lock controller 14 which may reside in a smart junction box (SJB) of the vehicle electrical system. An SJB may integrate electronic controls of various vehicle systems and options. Alternatively, the lock control function could be integrated in any other body electronic module or in a stand alone module.

A human-machine interface for controlling various door functions may include a button panel 15 (e.g., mounted to a driver's door) having a power lock toggle switch 16, a child lock switch 17, and a power sliding-door switch 18 which are all coupled to lock controller 14. Power lock toggle switch 16 has an unlock legend 20 and a lock legend 21 that may be pressed in order to send a corresponding unlock or lock signal to lock controller 14. Child lock switch 17 may preferably be a push-push switch associated with an indicator light 22 for showing whether the child lock feature is activated or deactivated. Power sliding-door switch 18 has a closed legend 23 and an open legend 24 that are pressed in order to generate signals for powered opening or closing of the sliding door.

In a typical power lock system, the state of the power lock determines whether door 10 can be opened using outside handle 11. More specifically, an unlock or lock signal from toggle switch 16 (or other control switches in the vehicle or on a wireless remote key fob), cause lock controller 14 to configure latch system 13 in either 1) an outside locked state for preventing the sliding door from being moved from the closed position using outside handle 11 or 2) an outside unlock state which enables the sliding door to be moved from the closed position using outside handle 11.

A power child lock function is comprised of an inside locked state or an inside unlocked state. To turn on the power child lock function, switch 17 is depressed, causing indicator 22 to illuminate and lock controller 14 to configure latch system 13 to the inside locked state which prevents the sliding door from being moved from the closed position using interior handle 12. By pressing switch 17 again, the inside unlocked state is selected which enables the sliding door to be moved from the closed position using interior handle 12. In a typical North American rear door system, the latch may be in a locked state but the latch can be mechanically unlocked from the inside of the rear door allowing the interior handle to unlatch and open the door from the inside. The child lock function works similar to the double lock system as generally used in Europe. A double lock state is set by sending a lock command to a latch that is already single locked. In a single locked state, the latch can be mechanically unlocked from the inside of the rear door allowing the inside handle to open the door. In the double locked state, the mechanical unlocking function of the inside handle is disabled just as it is in the child lock system employed in North America. As used herein, "child lock" refers to either system.

In the present invention, lock controller 14 preferably includes a memory for storing the status of the power lock state and the child lock state. By preserving the states most recently chosen by the vehicle occupants, the present invention can alter the states temporarily and then restore them.

Figure 2:
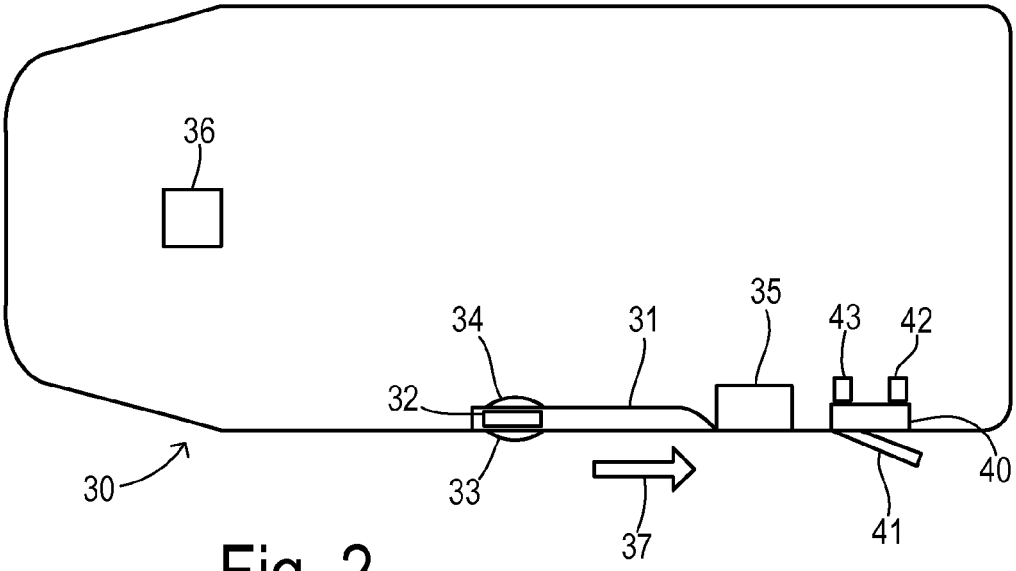
FIG. 2 generally illustrates a powered sliding door on the same side of a vehicle as a refueling door.

FIG. 2 shows a vehicle 30 having a power-driven sliding door system that may be present in a vehicle using the invention. A sliding door 31 has a latch system 32, an outside door handle 33, and an inside door handle 34. A power-drive system 35 is coupled with sliding door 31 for driving the sliding door 31 open and closed. A controller 36 is coupled to latch system 32 and power-driver 35 for coordinating system operation.

Sliding door 31 can be opened in a direction shown by arrow 37 toward a refueling unit 40 mounted to the same side of vehicle 30. A fuel door 41 has opened and closed positions for selectably covering a gas gap and filler neck (not shown). A fuel door lock 42 may be remotely controlled (e.g., by controller 36) to selectably lock and unlock fuel door 41 in its closed position. A door ajar sensor 43 provides a signal to controller 36 indicating whether fuel door 41 is in the open position or the closed position. When fuel door 41 is in an open position as shown in FIG. 2, sliding door 31 should not be capable of being opened to a position that collides with fuel door 41 either by powered driving by driver 35 or by manual opening using handles 33 or 34.

Figure 3:
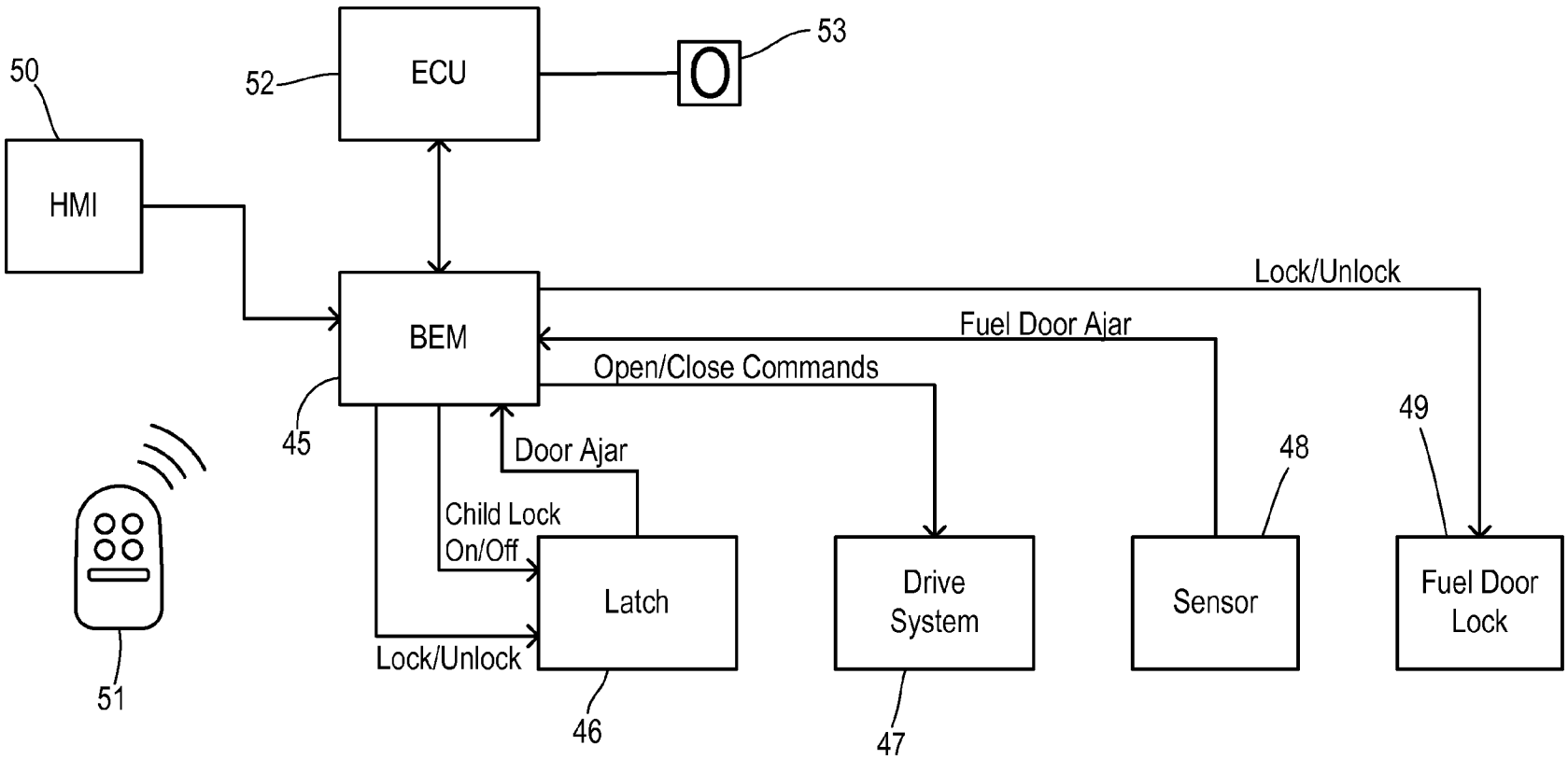
FIG. 3 is an electrical block diagram of one preferred embodiment of the invention.

FIG. 3 shows the electrical components and signals of an embodiment of the invention in greater detail. A lock controller is incorporated within a body electronic module (BEM) 45 and provides lock/unlock commands and child lock on/off commands to a latch system 46 of the sliding door on the side with the fuel door. Latch system 46 may optionally provide a door ajar signal to lock controller 45 indicating when the sliding door is open. A sliding-door drive system 47 receives open and close commands from controller 45. A fuel door sensor 48 provides a fuel door ajar signal to controller 45, and a fuel door lock system 49 receives lock and unlock commands from controller 45.

A human-machine interface (HMI) 50 and/or a remote fob 51 provide operator signals to controller 45, preferably including manual power lock and unlock commands and a power child lock setting. In addition, a manual fuel door lock control in HMI 50 or fob 51 can control the unlocking of fuel door power lock system 49 when the user desires to initiate the refueling of the vehicle.

Controller 45 may also be coupled to an engine control unit (ECU) 52 which is connected to a vehicle start switch 53 for reasons discussed below.

Figure 4:
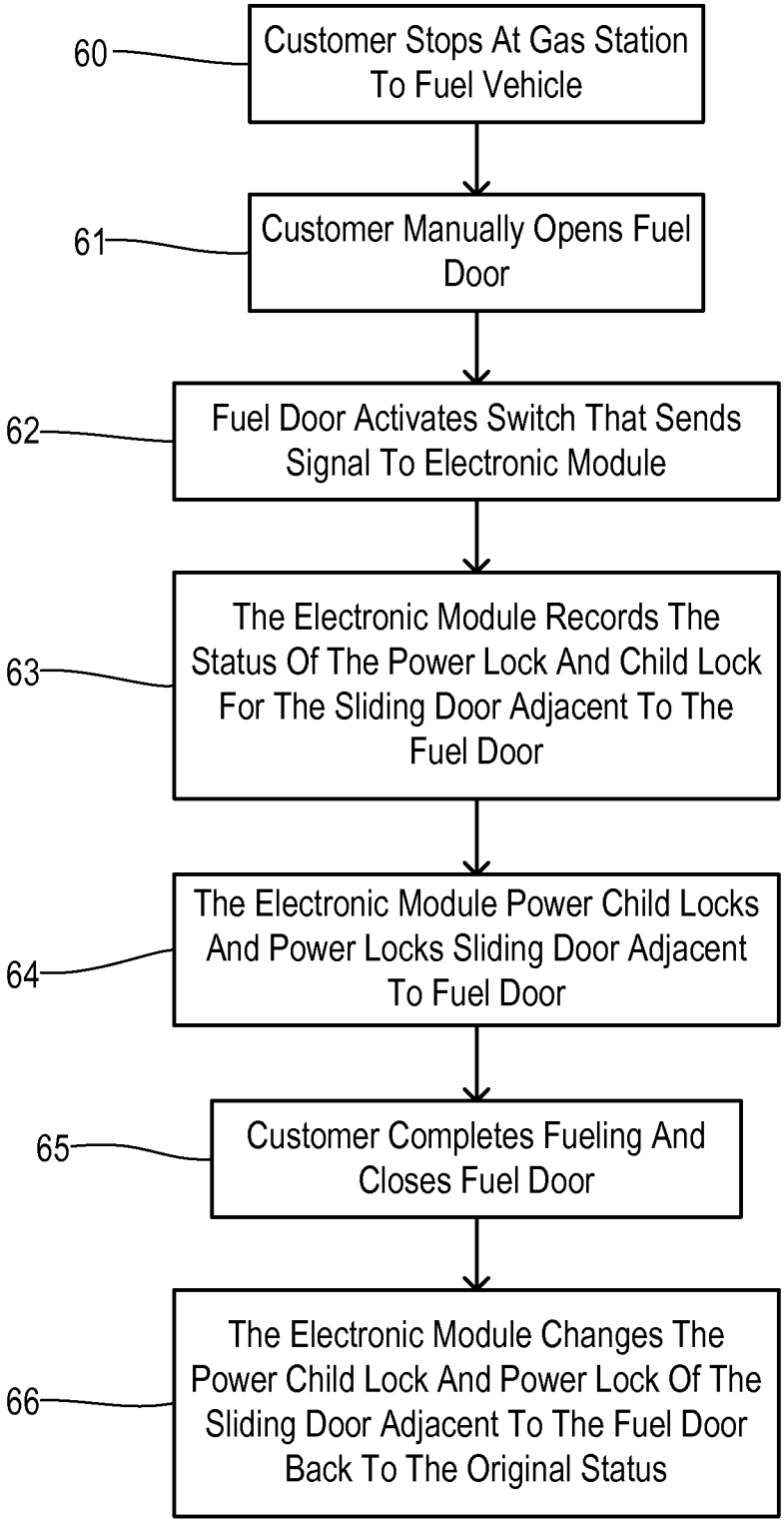
FIG. 4 is a flowchart of a first embodiment of a method of the present invention.

Using the electrical signals and subsystems shown in FIG. 3, the present invention provides a logic-based fuel door interlock system for preventing opening of the sliding door whenever it could collide with an open fuel door. The logic-based system avoids the added cost and disadvantages of a mechanical interlock. Furthermore, it prevents not only powered opening of the sliding door, but manual opening as well. FIG. 4 shows a first embodiment of the present invention wherein the customer stops at a gas station to fuel their vehicle in step 60. In step 61, the customer manually opens the fuel door (after power unlocking the fuel door if so equipped). Upon opening, the fuel door activates a sensor switch that sends a corresponding signal to the electronic control module in step 62. The electronic control module records the status (i.e., current lock states) of the power lock and the power child lock for the sliding door that is adjacent to the fuel door.

In order to ensure that the sliding door cannot be opened, the electronic control module power child locks and power locks the sliding adjacent to the fuel door in step 64. This prevents manual opening of the sliding door from either the inside or the outside of the vehicle and prevents powered opening from any door control switches (e.g., incorporated in the door handles or toggle switches within the vehicle). After the customer completes the fueling, the fuel door is closed in step 65. In response to the closing of the fuel door, the electronic module changes the power child lock and power lock for the sliding door adjacent to the fuel door back to their original status in step 66.

Figure 5:
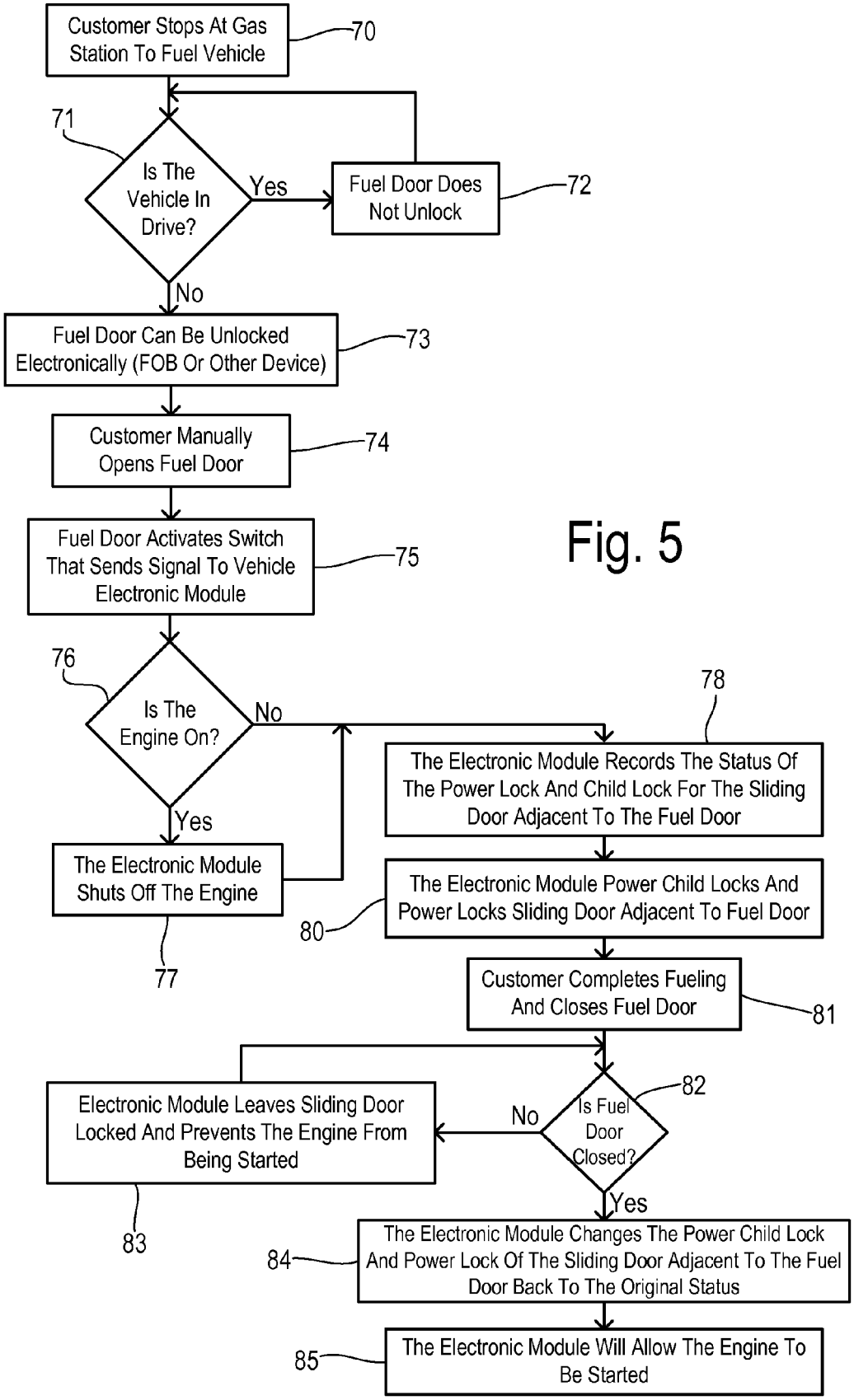
FIG. 5 is a flowchart of a second embodiment of a method of the present invention.

A more detailed method is shown in FIG. 5. The customer stops at a gas station to fuel their vehicle in step 70. A check is made in step 71 to determine whether the vehicle is stopped (e.g., by checking the transmission drive setting or checking if the speedometer indicates a speed below a predetermined value). If the vehicle is not stopped, then the fuel door is not allowed to unlock in step 72 and a return is made to step 71 to wait for the vehicle to stop. When the vehicle is stopped, the fuel door can be unlocked electronically in step 73 using a fob or other HMI control device in the vehicle. In step 74, the customer manually opens the fuel door in order to remove the gas cap and begins refueling the vehicle. Upon opening of the fuel door, a fuel door sensor switch is activated and sends a signal to the electronic control module in step 75.

In this embodiment, a check is made in step 76 to determine whether the internal combustion engine is on (i.e., running). If so, then the electronic control module sends an engine shutoff command in step 77 to the engine control unit in order to shut-off the engine during refueling. After the engine is shut off or if the engine was not on, the method proceeds to step 78 wherein the electronic control module records the states of the power lock and child lock for the sliding door adjacent to the fuel door. Then the electronic control module power child locks and power locks the sliding door adjacent the fuel door in step 80.

The customer completes fueling and closes the fuel door in step 81. A check is made in step 82 to determine whether the fuel door has closed. If not, the electronic module leaves the sliding door locked and prevents the engine from being started in step 83. Then, a return is made to step 82 to wait for the customer to close the fuel door. During the time that the fuel door remains ajar, a warning light or a message on an HMI will preferably indicate to the driver that the fuel door is open and the engine disabled. After the fuel door is closed, the electronic control module changes the power child lock state and the power lock state of the sliding door adjacent to the fuel door back to the original states in step 84. The electronic control module then allows the engine to be started in step 85 (e.g., by sending a signal to the engine control unit to no longer disable engine starting).

In an alternative embodiment, when the vehicle includes a remote-controlled fuel door lock system it may be desirable to inhibit unlocking of the fuel door unless the sliding door is in its closed position so that it can be locked closed prior to allowing the fuel door to open. In yet another alternative, the act of causing the fuel door to unlock may trigger the interlock function, i.e., without relying on the fuel door ajar sensor to signal the opening of the fuel door before the sliding door is locked.

What is claimed is:

1. A transportation vehicle comprising:

a fuel door on a first side of the vehicle and having an open position and a closed position;

a sensor providing a fuel door ajar signal indicating whether the fuel door is in the open position or the closed position;

a sliding door on the first side of the vehicle for passenger ingress and egress, wherein the sliding door is movable between an open position and a closed position, wherein the open position of the sliding door interferes with the open position of the fuel door, and wherein the sliding door has an interior door handle and an exterior door handle;

at least one power lock switch for manually generating a lock signal or an unlock signal;

a child lock switch for manually generating a power child locking signal or a power child unlocking signal;

an electronically-controlled latch system in the sliding door responsive to 1) a power lock command for putting the latch system in an outside locked state for preventing the sliding door from being moved from the closed position using the exterior door handle, 2) a power unlock command for putting the latch system in an outside unlocked state for enabling the sliding door to be moved from the closed position using the exterior door handle, 3) a child lock command for putting the latch system in an inside locked state for preventing the sliding door from being moved from the closed position using the interior door handle, and 4) a child unlock command for putting the latch system in an inside unlocked state for enabling the sliding door to be moved from the closed position using the interior door handle;

a lock controller coupled to the sensor, the power lock switch, the child lock switch, and the latch system, the lock controller responding to the fuel door moving to the open position by 1) preserving a current outside locked or unlocked state and a current inside locked or unlocked state, 2) initiating or maintaining the outside locked state and inside locked state, and 3) after the fuel door moving to the closed position, restoring or maintaining the preserved current outside locked or unlocked state and the preserved current inside locked or unlocked state.

2. The vehicle of claim 1 further comprising:

at least one power door switch for manually generating a door open signal or a door close signal;

a sliding door actuator including a motor for driving the sliding door between the open position and the closed position in response to the door open signal and door close signal;

wherein the lock controller is coupled to the sliding door actuator for inhibiting driving the sliding door toward the open position when the fuel door is in the open position.

3. The vehicle of claim 1 further comprising:

a remote-controlled fuel door lock having a locked state and an unlocked state, wherein the lock controller preserves the current outside locked or unlocked state and the current inside locked or unlocked state and initiates or maintains the outside locked state and inside locked state in response to either the remote-controlled fuel door being in the unlocked state or the fuel door moving to the open position.

4. A transportation vehicle comprising:

a fuel door on a first side of the vehicle and having an open position and a closed position;

a sensor providing a door ajar signal indicating whether the fuel door is in the open position or the closed position;

a fuel lock system having a lock mechanism with an unlocked state and a locked state for selectably locking the fuel door in the closed position, the fuel lock system having a manual control element for selecting the locked or unlocked state;

a sliding door on the first side of the vehicle for passenger ingress and egress, wherein the sliding door is movable between an open position and a closed position, wherein the open position of the sliding door interferes with the open position of the fuel door, and wherein the sliding door has an interior door handle and an exterior door handle;

at least one power lock switch for manually generating a lock signal or an unlock signal for the sliding door;

a child lock switch for manually generating a power child locking signal or a power child unlocking signal for the sliding door;

an electronically-controlled latch system in the sliding door responsive to 1) a power lock command for putting the latch system in an outside locked state for preventing the sliding door from being moved from the closed position using the exterior door handle, 2) a power unlock command for putting the latch system in an outside unlocked state for enabling the sliding door to be moved from the closed position using the exterior door handle, 3) a child lock command for putting the latch system in an inside locked state for preventing the sliding door from being moved from the closed position using the interior door handle, and 4) a child unlock command for putting the latch system in an inside unlocked state for enabling the sliding door to be moved from the closed position using the interior door handle;

a lock controller coupled to the fuel lock system, the sensor, the power lock switch, the child lock switch, and the latch system, the lock controller responding to the selection of the unlocked state of the fuel lock system by 1) preserving a current outside locked or unlocked state and a current inside locked or unlocked state, 2) initiating or maintaining the outside locked state and the inside locked state, and 3) after the fuel door moving to the closed position, restoring or maintaining the preserved current outside locked or unlocked state and the preserved current inside locked or unlocked state.

5. The vehicle of claim 4 further comprising:

at least one power door switch for manually generating a door open signal or a door close signal;

a sliding door actuator including a motor for driving the sliding door between the open position and the closed position in response to the door open signal and door close signal;

wherein the lock controller is coupled to the sliding door actuator for inhibiting driving the sliding door toward the open position when the fuel door is in the open position.

6. A method of preventing collision of a sliding door with a fuel door on a vehicle, wherein the sliding door has interior and exterior door handles, comprising the steps of:

detecting opening of the fuel door;

saving a current power lock state and a current child lock state;

locking the sliding door against being opened from either door handle;

detecting closing of the fuel door; and restoring the current power lock and child lock states.

* * * * *